US006561833B2

(12) United States Patent
Saka et al.

(10) Patent No.: US 6,561,833 B2
(45) Date of Patent: May 13, 2003

(54) CONNECTOR AND A METHOD FOR ASSEMBLING A CONNECTOR

(75) Inventors: Yukinori Saka, Yokkaichi (JP); Koji Okutani, Yokkaichi (JP); Atsushi Yamaoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/076,777

(22) Filed: Feb. 14, 2002

(65) Prior Publication Data

US 2002/0173194 A1 Nov. 21, 2002

(30) Foreign Application Priority Data

May 18, 2001 (JP) ..... 2001-149894

(51) Int. Cl.[7] ..... H01R 13/627
(52) U.S. Cl. ..... 439/352
(58) Field of Search ..... 439/350–358, 439/489

(56) References Cited

U.S. PATENT DOCUMENTS 5,749,747 A * 5/1998 Inaba et al. ..... 439/358
5,938,470 A 8/1999 Kashiyama ..... 439/489
6,102,726 A * 8/2000 Tsuji et al. ..... 439/352
6,241,542 B1 6/2001 Nishide et al. ..... 439/188

FOREIGN PATENT DOCUMENTS

EP 1 085 614 A2 3/2001

* cited by examiner

*Primary Examiner*—P. Austin Bradley
*Assistant Examiner*—Ross Gushi
(74) *Attorney, Agent, or Firm*—Gerald E. Hespos; Anthony J. Casella

(57) ABSTRACT

A connector has male and female housings (10, 20) that are fitted to each other. A pushable portion (58) is pushed by a pushing portion (14) of the male housing (10) so that a slider (51) resiliently compresses springs (50) to move the slider (51) back in the female housing (20) while accumulating biasing forces that urge the slider (51) forward. Guidable portions (61) of the slider (51) are engaged with guides (41) in a terminal accommodating portion (21), and the slider (51) is inclined about axes of supporting pins (60) at its rear. When the housings (10, 20) are connected properly and the slider (51) is inclined sufficiently, the pushable portion (58) disengages from the pushing portion (14), and the biasing forces of the springs (50) are released. As a result that the slider (51) is moved forward at an inclined posture.

11 Claims, 11 Drawing Sheets

CONNECTOR AND A METHOD FOR ASSEMBLING A CONNECTOR

BACKGROUND OF THE INVENTION

1. Field of the Invention

The invention relates to a connector with a partial connection preventing function and to a method for assembling such a connector.

2. Description of the Related Art

A connector with a partial connection preventing function is disclosed in U.S. Pat. No. 6,241,542. This connector includes male and female housings that are connectable with each other. A lock arm is provided in the male housing and a slider is mounted above the lock arm in the male housing. Compression coil springs also are provided in the male housing for biasing the slider. The female housing is formed with a lock for engaging the lock arm and pushing ribs for pushing the compression coil springs. When the housings are fitted to each other, the lock arm is deformed resiliently by the lock and moves onto the lock, and the compression coil springs are compressed resiliently by the pushing ribs and accumulate biasing forces that act in a direction to separate the housings. If the connecting operation is interrupted halfway, the biasing forces of the compression coil springs are released to separate the housings and prevent partial connection. The lock arm is restored resiliently to engage the lock when the housings are connected properly. Thus, the biasing forces of the compression coil springs are released to move the slider backward.

The pushing ribs are provided before the slider along the connecting direction. Thus, the slider must be moved back to return the compression coil springs when the housings are connected. However, this construction makes the connector longer in the connecting direction by the distance the slider is moved back.

In view of the above situation, an object of the present invention is to make a connector with a partial connection preventing function that is smaller in the connecting direction.

SUMMARY OF THE INVENTION

The invention is directed to a connector with first and second housings that are connectable with each other. The first housing has a resilient or elastic member for accumulating a biasing force that acts in a direction to separate the housings as the two housings are fit to each other. The resilient member has a pushable portion that can be pushed by a pushing portion in the second housing. A guide is provided for guiding the resilient member at an angle to the connecting direction. Thus, the resilient member is displaced to a position where it is no longer pushed by the pushing portion, thereby moving the resilient member forward as the housings are connected properly.

The pushing portion of the second housing pushes the pushable portion of the resilient member when the housings are fitted to each other. Thus, the resilient member is compressed and accumulates a biasing force that acts in the direction to separate the housings. If the connecting operation is interrupted, the biasing force accumulated in the resilient member is released to separate the two housings. As a result, partial connection can be prevented. As the two housings are connected properly, the pushable portion is guided by the guide in a direction that intersects the connecting direction and into a position offset from the pushing portion. Thus, the resilient member elongates forward and releases the already accumulated biasing force. Consequently, the connector can be small in the connecting direction, as compared to a prior art connector in which the resilient member is moved backward along connecting direction.

According to a preferred embodiment, the pushing portion is provided at a nonresilient portion of the second connector housing.

The resilient member initially may be arranged substantially along the connecting direction. More particularly, the resilient member has its rear end mounted on a supporting portion in the first housing, and has its front end mounted on a movable element that includes the pushable portion. The guide guides the movable element as the housings are connected properly to cancel the pushed state of the pushable member and the movable member is held in an upwardly sloped inclined posture from its rear end toward its front end. At this stage, the resilient member with its rear end mounted on the supporting portion is held in an inclined posture similar to the movable element.

The connector can be small in a direction that intersects the connecting direction, as compared to a case where the movable element extends along the connecting direction when the housings are connected properly. Further, the resilient member can be held in an inclined posture. Thus, stress on the resilient member low as compared to a case where the resilient member is bent if the movable element is held in such a posture extending along the connecting direction with the housings properly connected.

The movable element preferably contacts a stopper in the first housing and is supported by the outer surface of the second housing while causing the resilient member to accumulate the biasing force when the housings are connected properly. The stopper preferably is slanted to guide the movable element to its initial position by the biasing force accumulated by the resilient member as the second housing is separated from the first housing.

The inclined movable element loses the support of the second housing if the properly connected housings are separated. Thus, the biasing force accumulated in the resilient member is released and the slanted stopper guides the movable element back to its initial position. Operability during separation is good because the movable element returns automatically to its initial position.

The movable element preferably is pivotable about an axis so that the movable element can be oriented substantially parallel to the connecting direction or in a slanted orientation where its longitudinal axis is at an angle to the connecting direction.

The pushable portion that is in the slanted orientation is not pushed by the pushing portion as the two housings are connected properly.

The second housing may comprise a substantially tubular receptacle with an open front, and the pushing portion may be formed by an opening edge of the receptacle. Thus, the second housing need not have a special pushing portion, and its construction can be simplified.

The invention also is directed to a method for assembling a connector that comprises first and second connectable housings. The method comprises fitting the housings with each other and thereby accumulating in a resilient member of the first housing a biasing force that acts to separate the housings. The method then comprises pushing a pushable portion of the resilient member by a pushing portion of the second housing, and guiding the pushable portion in a direction that intersects the connecting direction to displace the pushable portion to a position where a state pushed by the pushing portion is canceled, thereby moving the resilient member forward, as the housings are connected.

The resilient member, and preferably a movable element thereof, is held in an upwardly sloped inclined posture from its rear end toward its front end when the housings are connected properly.

A movable element of the resilient member may contact a stopper in the first housing and is supported by the outer surface of the second housing while causing the resilient member to accumulate the biasing force when the two housings are properly connected with each other.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

A connector according the invention has a male housing 10 and a female housing 20 that are connectable with each other, as shown in FIGS. 1–13. Ends of the housings 10, 20 that are to be connected with each other are referred to as the front in the following description, and the vertical direction is based on the drawings except FIG. 6.

Figure 1:
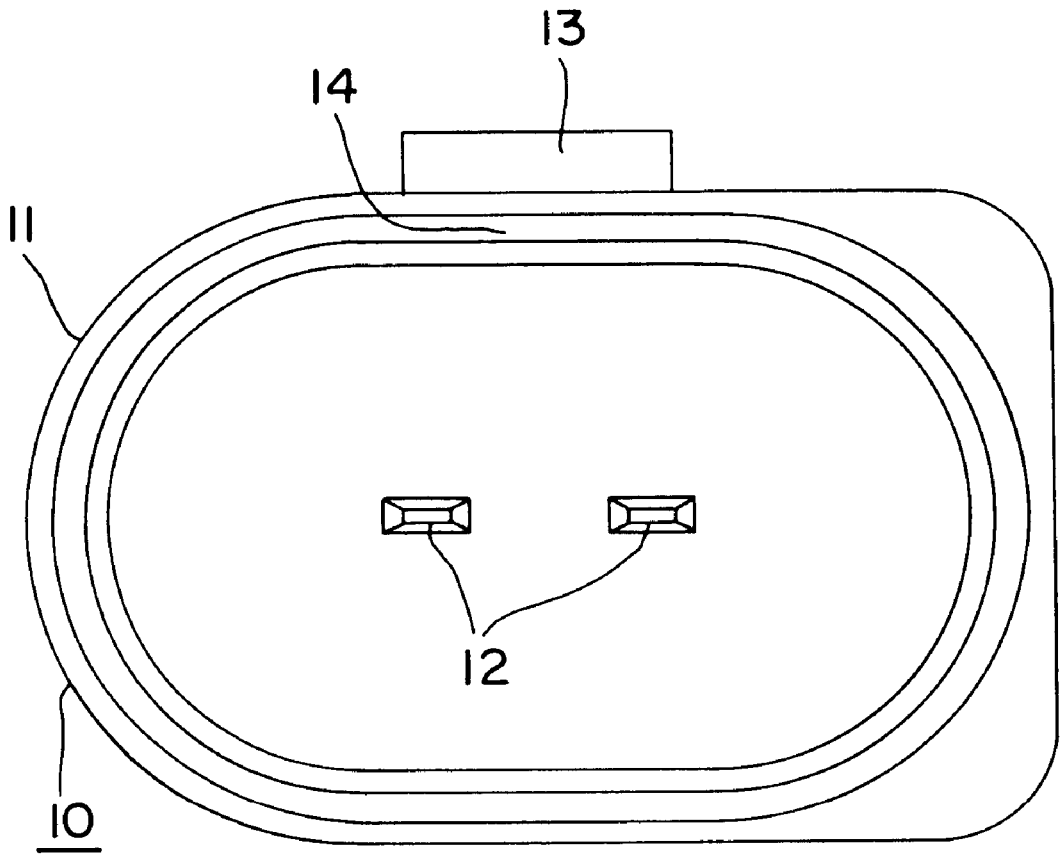
FIG. 1 is a front view of a male housing according to the invention.
Figure 2:
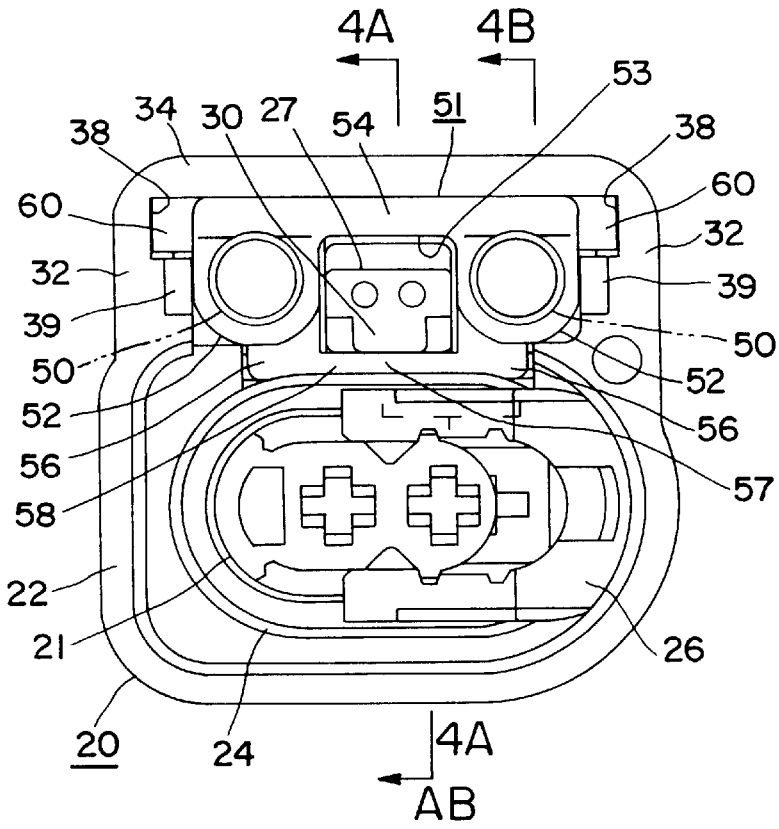
FIG. 2 is a front view of a female housing and slider.
Figure 4A:
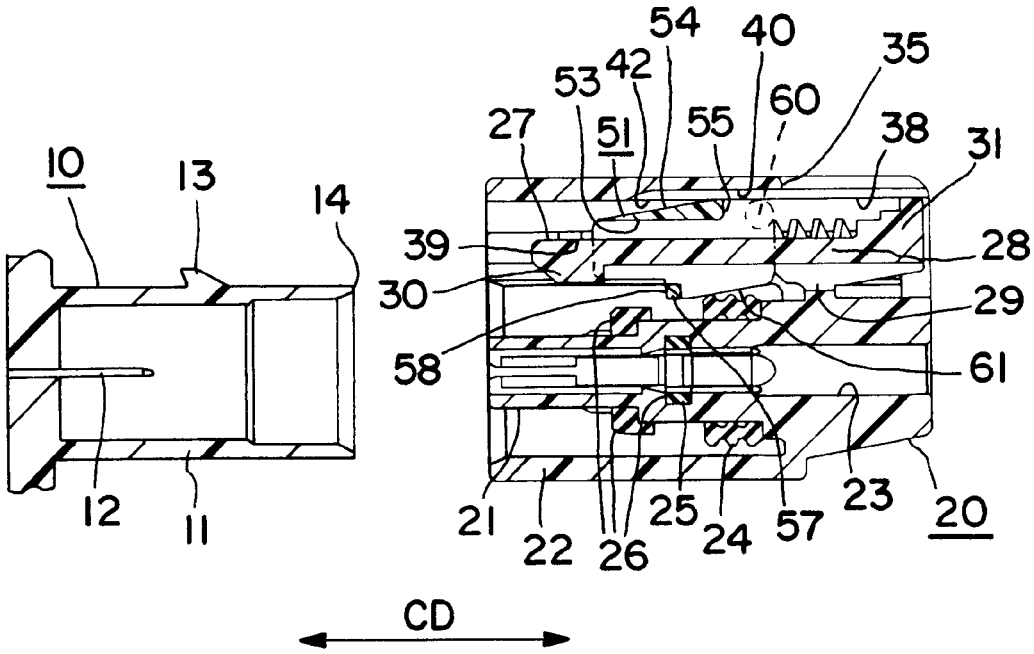
FIGS. 4(A) and 4(B) are sections along 4A—4A, 4B—4B of FIG. 2 showing a state before the two housings are connected.
Figure 4B:
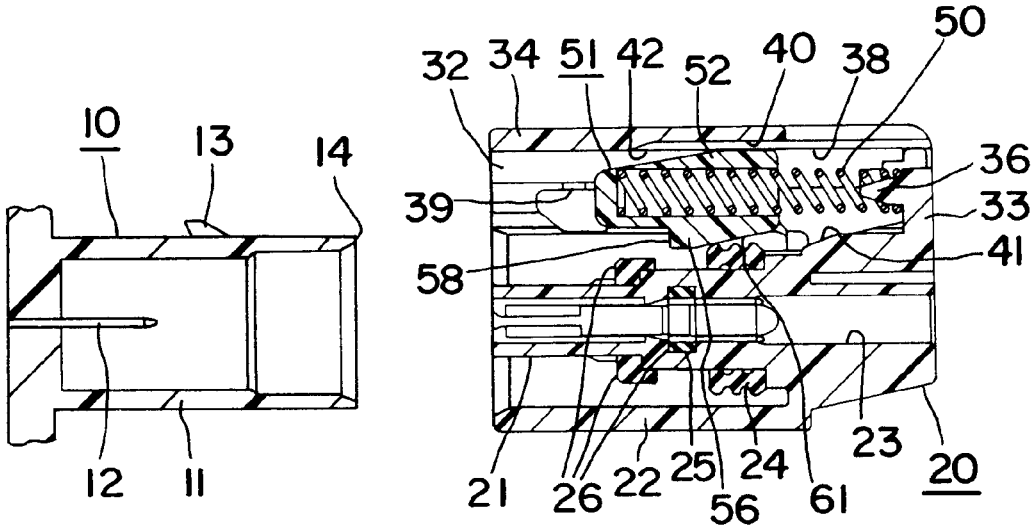

The male housing 10, as shown in FIGS. 1, 4(A) and 4(B), has a substantially cylindrical synthetic resin receptacle 11 that is formed integrally or unitarily with a wall of a piece of equipment and that opens forward. Two male tab terminals 12 project from a back wall of the male housing 10. The male tab terminals 12 are substantially surrounded by the receptacle 11 and are electrically connectable with female terminal fittings in the female housing 20. A lock 13 is provided at a widthwise center on the upper surface of the receptacle 11 and the front surface of the lock 13 is slanted. An upper part of an opening edge of the receptacle 11 defines a substantially nonresilient and nonelastic pushing portion 14.

The female housing 20 is made e.g. of a synthetic resin and has a terminal accommodating portion 21 for accommodating unillustrated female terminal fittings. An outer tube 22 is coupled to the outer surface of the terminal accommodating portion 21 and is open forward. Side-by-side cavities 23 are formed inside the terminal accommodating portion 21 at positions corresponding to the male tab terminals 12. The cavities 23 are configured to permit insertion of the female terminal fittings from behind. A seal ring 24 is mounted on the terminal accommodating portion 21 from the front and can be squeezed between the outer surface of the terminal accommodating portion 21 and the inner surface of the receptacle 11 for sealing a clearance between the housings 10, 20. A retainer mounting hole 25 is formed in a side surface of the female housing 20 and communicates with the respective cavities 23. A retainer 26 is mountable in the retainer mounting hole 25, and locks of the retainer 26 project into the cavities 23 to lock the respective female terminal fittings therein.

Figure 3:
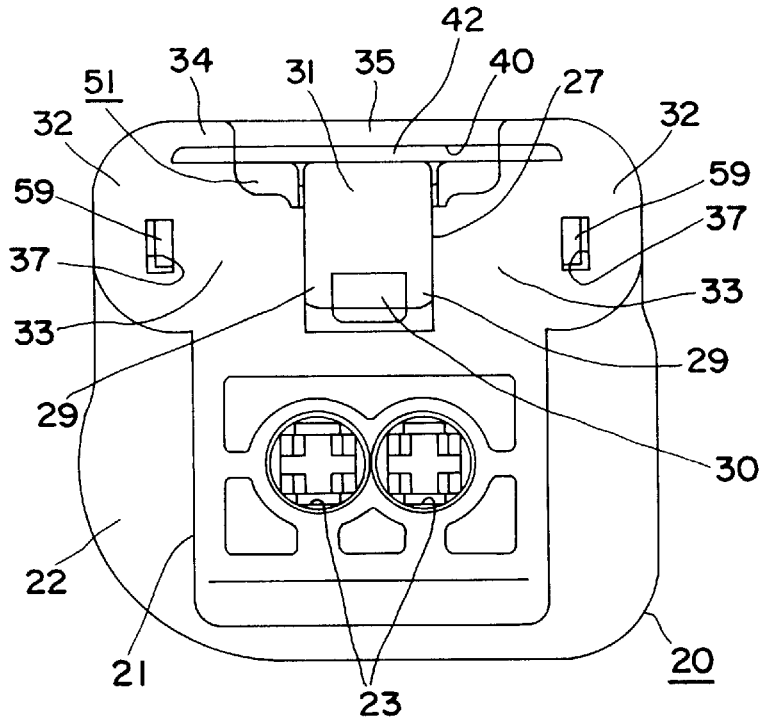
FIG. 3 is a rear view of the female housing and the slider.

A lock arm 27 projects substantially at the widthwise center of the upper surface of the terminal accommodating portion 21 in a position that corresponds to the lock 13. The lock arm 27 has a seesaw shape with an arm 28 that extends longitudinally along a connecting direction CD. A lower surface of the arm 28 is coupled to the outer surface of the terminal accommodating portion 21 by left and right coupling portions 29, which are behind the seal ring 24, as shown in FIGS. 3 and 4(A). The arm 28 is resiliently or elastically displaceable up and down with a pivotal movement about the coupling portions 29. A locking claw 30 projects down from the lower surface at the front end of the lock arm 27, and the housings 10, 20 are held properly locked into each other by the engagement of the rear surface of the locking claw 30 with the rear surface of the lock 13. An operable portion 31 projects up in three steps from the upper surface of the rear end of the lock arm 27. Thus, the lock arm 27 can be deformed resiliently by pressing this operable portion 31 from above.

Figure 5:
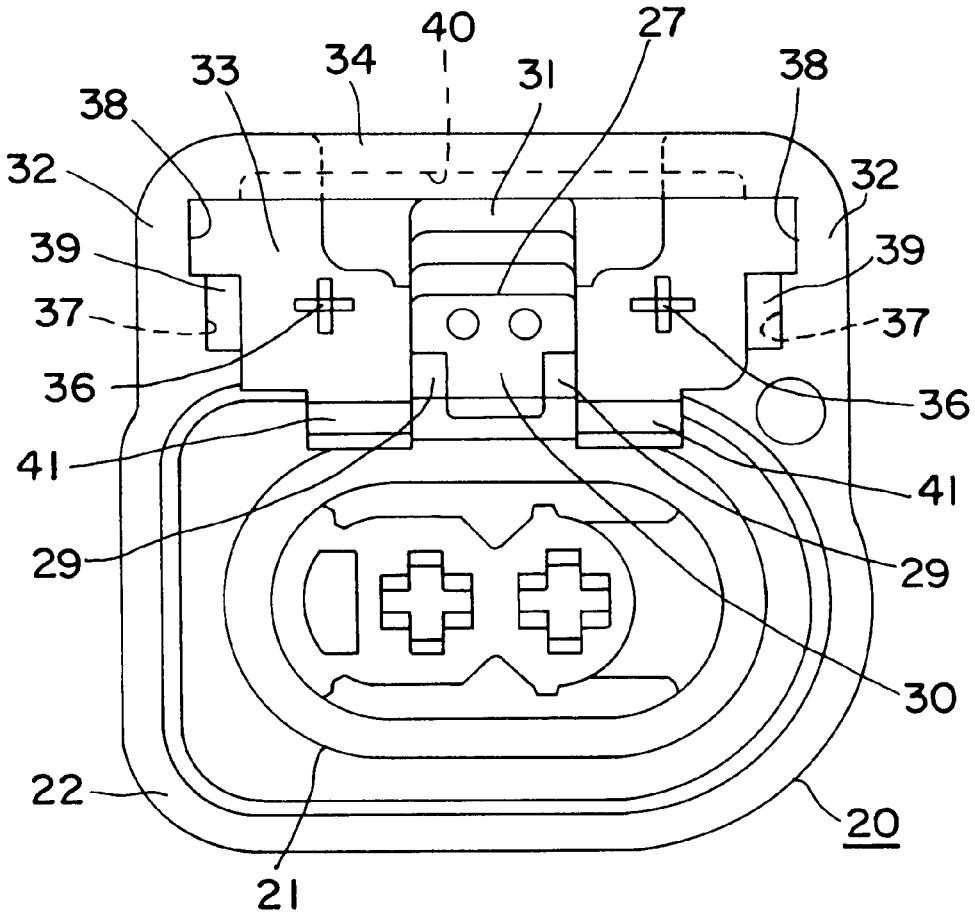
FIG. 5 is a front view of the female housing and the slider.
Figure 5:
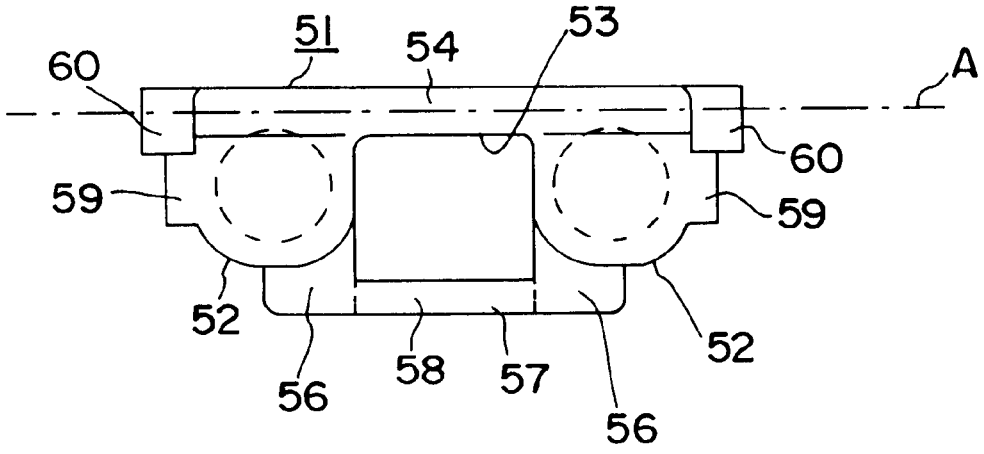
Figure 6:
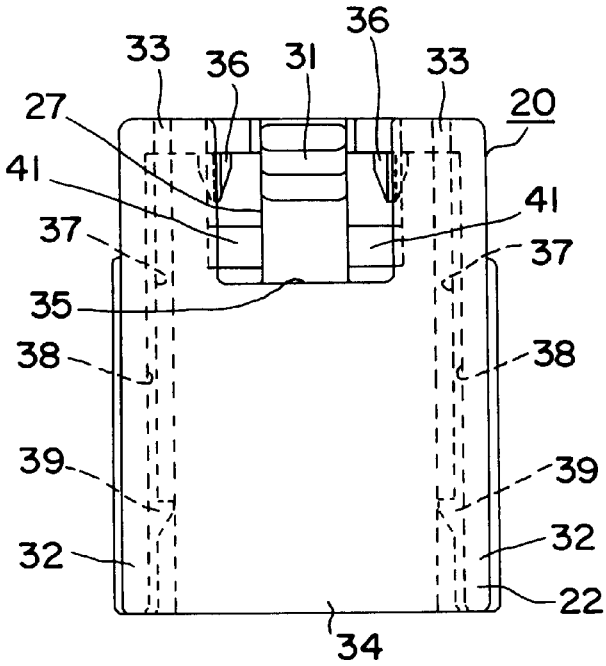
FIG. 6 is an exploded plan view of the female housing, compression coil springs and the slider.
Figure 6:
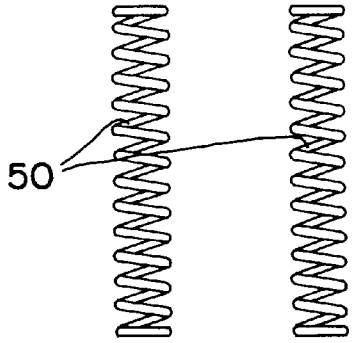
Figure 6:
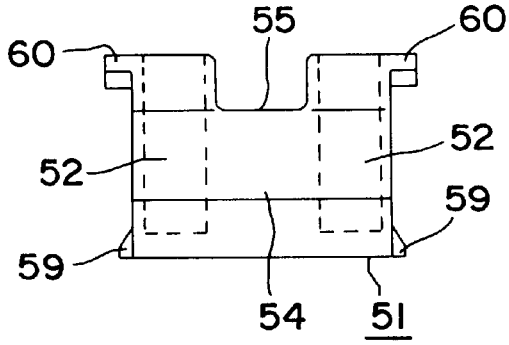

The receptacle 11 of the male housing 10 is fittable inside a lower part of the outer tube 22 that surrounds the terminal accommodating portion 21 from the front. An upper part of the outer tube 22 is formed to substantially surround the lock arm 27 on the upper surface of the terminal accommodating portion 21, as shown in FIGS. 5 and 6. The upper part of the outer tube 22 includes two side walls 32, two rear walls 33 connected with the rear ends of the side walls 32, and a ceiling wall 34 connected with the upper ends of the side walls 32 and the rear walls 33. A notch 35 is formed at the rear end of the ceiling wall 34 to expose the operable portion 31 of the lock arm 27.

Compression coil springs 50 are held in the female housing 20 by inserting their rear ends into cross-like supporting projections 36 on the rear walls 33. A slider 51 is mounted on the female housing 20 from the front, and has spring accommodating portions 52 for receiving the front ends of the springs 20. The slider 51 is movable longitudinally forward and backward inside the outer tube 22, and can resiliently compress the coil springs 50, thereby accumulating a biasing force that biases the slider 51 forward and towards the male housing 10 (see FIG. 10(B)). The slider 51 and the coil springs 50 both are initially substantially parallel to connecting direction CD, as shown in FIGS. 4(A) and 4(B), and the compression coil springs 50 are compressed slightly between the slider 51 and the rear walls 33.

The slider 51 is formed e.g. of a synthetic resin, and the two spring accommodating portions 52 that are bridged to define a frame-shape for the slider 52 in front view. A substantially rectangular lock arm insertion hole 53 is formed in the middle of the slider 51 and extends longitudinally in forward and backward directions. The lock arm 27 is insertable into the lock arm insertion hole 53, as shown in FIG. 5. The spring accommodating portions 52 are tubes with open rear ends for receiving the compression coil springs 50 and closed front ends for supporting the compression coil springs 50, as shown in FIGS. 4(B) and 6. An upper bridge 54 connects upper ends of the spring accommodating portions 52, as shown in FIG. 5. A clearance is defined between the upper bridge 54 and the upper surface of the lock arm 27, as shown in FIGS. 4(A) and 6, to avoid interference with the lock arm 27. The rear end of the upper bridge 54 is notched to form an escaping portion 55 (FIG. 6) for the operable portion 31. Rear parts 52*a* extend preferably less than half and most preferably about ⅓ of the entire length of the slider 51, and are horizontal surfaces substantially parallel to connecting direction CD. Front parts 52*b* extend preferably more than half and most preferably about ⅔ of the entire length of the slider 51, and are slanted surfaces that slope down to the front as the upper surface of the upper bridge 54 is (FIG. 9). Thus, the slanted front part 52*b* is at an angle $\alpha$ to the substantially horizontal rear part 52*b*, with the angle $\alpha$ preferably being $0<\alpha<90°$, and most preferably $0<\alpha\leqq 45°$.

Figure 7:
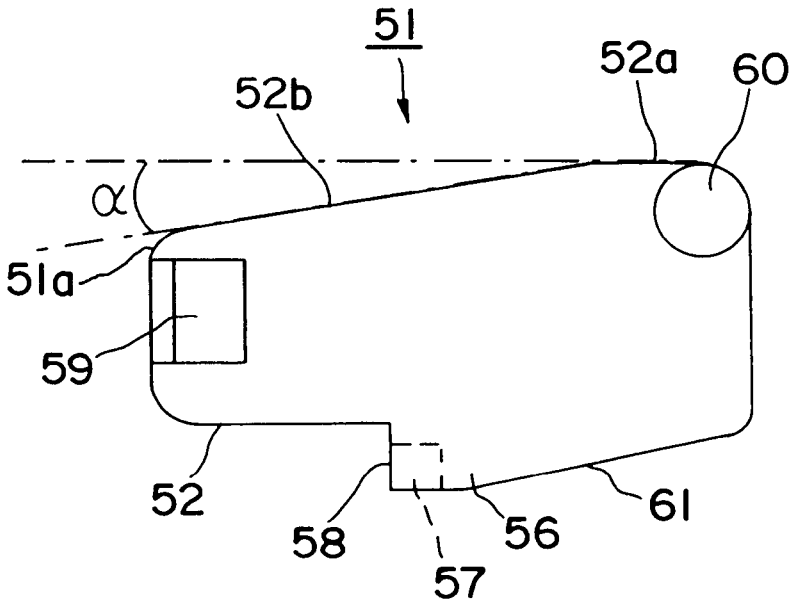
FIG. 7 is a side view of the slider.
Figure 8:
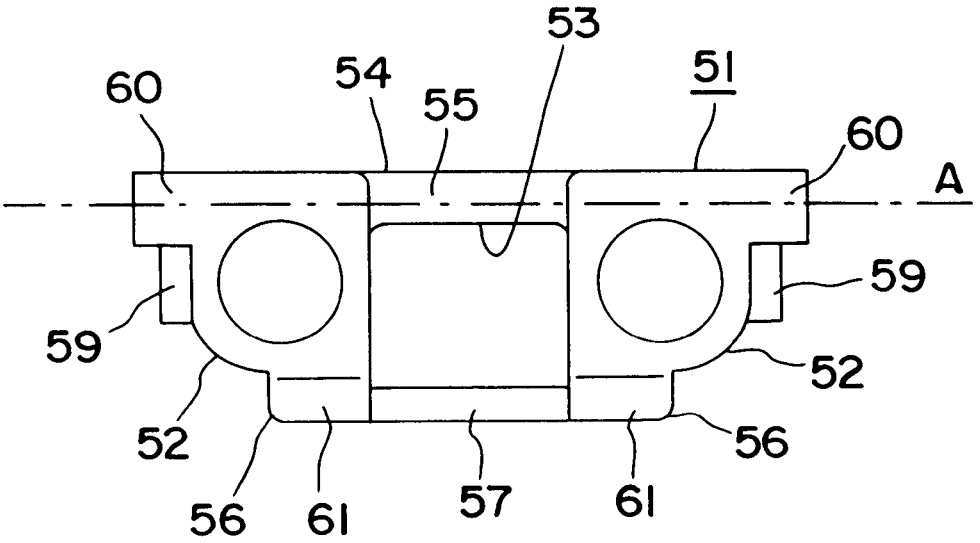
FIG. 8 is a rear view of the slider.

Backward extending ribs 56 project from the bottom surfaces of the spring accommodating portions 52 and are slightly retracted from their front ends, as shown in FIGS. 5 and 7. The front ends of the facing surfaces of the two ribs 56 are connected by a lower bridge 57 in the form of a substantially rectangular beam. The ribs 56 and the lower bridge 57 project into an area below the lock arm 27 where the receptacle 11 of the male housing 10 enters when the housings 10, 20 are fitted to each other. The front end surfaces thereof define a pushable portion 58 that can be pushed by the pushing portion 14 on the opening edge of the receptacle 11. The pushable portion 58 is substantially normal to the connecting direction CD of the housings 10, 20.

Front-stop projections 59 project sideways at front ends of the side surfaces of the spring accommodating portions 52, as shown in FIGS. 5–8. The front surfaces of the front-stop projections 59 are substantially parallel with the pushable portion 58, whereas the rear surfaces thereof are slanted at obtuse angles to the side surfaces of the spring accommodating portions 52. Cylindrical supporting pins 60 project sideways at rear ends of the upper parts of the side surfaces of the spring accommodating portions 52. The supporting pins 60 project laterally more than the front-stop projections 59 (FIG. 5), and are displaced upward from the front-stop projections 59.

The front-stop projections 59 and the supporting pins 60 are fittable in lower guide grooves 37 formed in the inner surfaces of the opposite side walls 32 and in upper guide grooves 38 formed above the lower guide grooves 37, as shown in FIGS. 5 and 6. The lower guide grooves 37 have a depth conforming to the projecting distance of the front-stop projections 59 and extend along connecting direction CD. Additionally, the lower guide grooves 37 have open rear ends. The upper guide grooves 38 are substantially continuous with the lower guide grooves 37 and are deeper than the lower guide grooves 37, in conformity with the supporting pins 60. Additionally, the upper guide grooves 38 extend along connecting direction CD and have open front ends. Front-stop walls 39 project at the front sides of the lower guide grooves 37 and engage the front-stop projections 59 to hold the slider 51 at its front limit position. The front surfaces of the front-stop walls 39 are slanted to guide movement of the front-stop projections 59 onto the front-stop walls 39, whereas the rear surfaces are substantially parallel with the front surfaces of the front-stop projections 59.

The lower surfaces of the front-stop projections 59 are in sliding contact with the bottom surfaces of the lower guide grooves 37 during the forward and backward movement of the slider 51, while the circumferential surfaces of the supporting pins 60 are in sliding contact with the upper and bottom surfaces of the upper guide grooves 38. Accordingly, a downward displacement of the front part of the slider 51 is prevented by the front-stop projections 59 during movement of the slider 51, while the rear part of the slider 51 is supported by the supporting pins 60 to be vertically immovable. In other words, the slider 51 is inclinable about a transverse axis A because the rear of the slider 51 is fixed with respect to the vertical direction while the front of the slider 51 permitted to displace upward and away from the cavities 23. Thus, the slider 51 can be displaced to an inclined posture where the slider 51 is sloped upward from its rear end toward its front end (see FIGS. 11(A) and 11(B)). The ceiling wall 34 is formed with a rearwardly open escaping groove 40 for permitting the front part of the slider 51 to displace upward. The escaping groove 40 is substantially as wide as portions of the slider 51 spaced from the supporting pins 60. The inclination of the slider 51 is permitted until the upper surface of the front end of the slider 51 contacts the upper surface of the escaping groove 40 (see FIG. 11(B)), and a permissible angle of inclination $\beta$ is set substantially the same as an angle of inclination of the slanted surface 52*b* formed on the upper surface of the front part of the slider 51. In other words, the slider 51 can be pivoted so that an axis IS thereof is rotated by an angle $\beta$ with respect to the connection direction CD. The angle $\beta$ preferably is $0°<\beta<90°$, and most preferably $0°<\beta\leqq 45°$.

The female housing 20 has guides 41 at the left and right sides of the coupling portions 29 of the lock arm 27, as shown in FIGS. 4(B) and 5. The guides 41 have upper surfaces that are sloped up and to the back. The upper surfaces of the guides 41 engage the rear surfaces of the ribs 56 of the slider 51, as shown in FIG. 11(B), and cause the slider 51 to incline about the supporting pins 60 as the slider 51 is moved backward from its initial position. Thus, the rear surfaces of the ribs 56 define guidable portions 61. The guidable portions 61 are slanted and slope up to the back, as shown in FIG. 4(B), and have an angle of inclination substantially equal to the slanted upper surface of the front part of the slider 51, but more moderate than the guides 41.

Figure 11A:
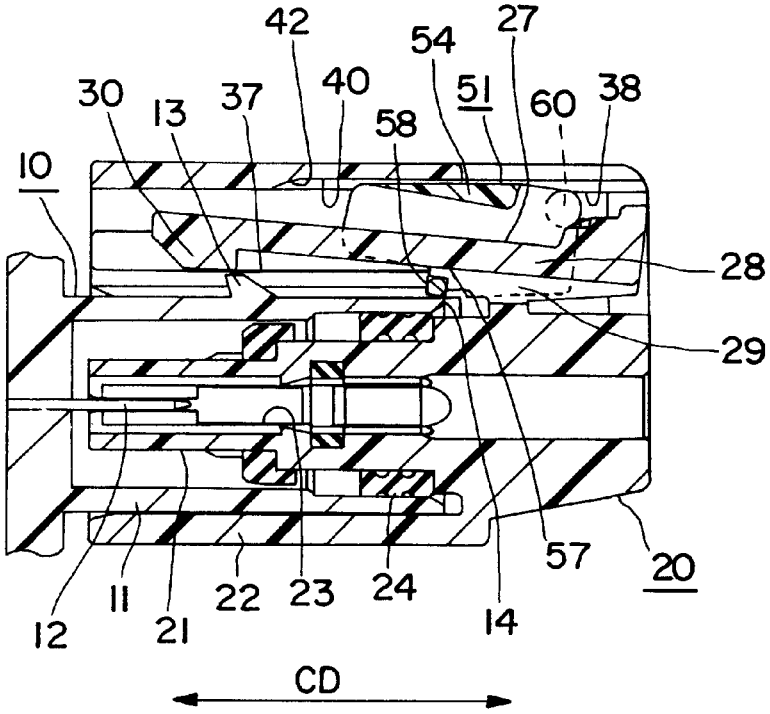
FIGS. 11(A) and 11(B) are sections similar to FIGS. 10(A) and 10(B) showing a state immediately before the two housings are connected properly.
Figure 11B:
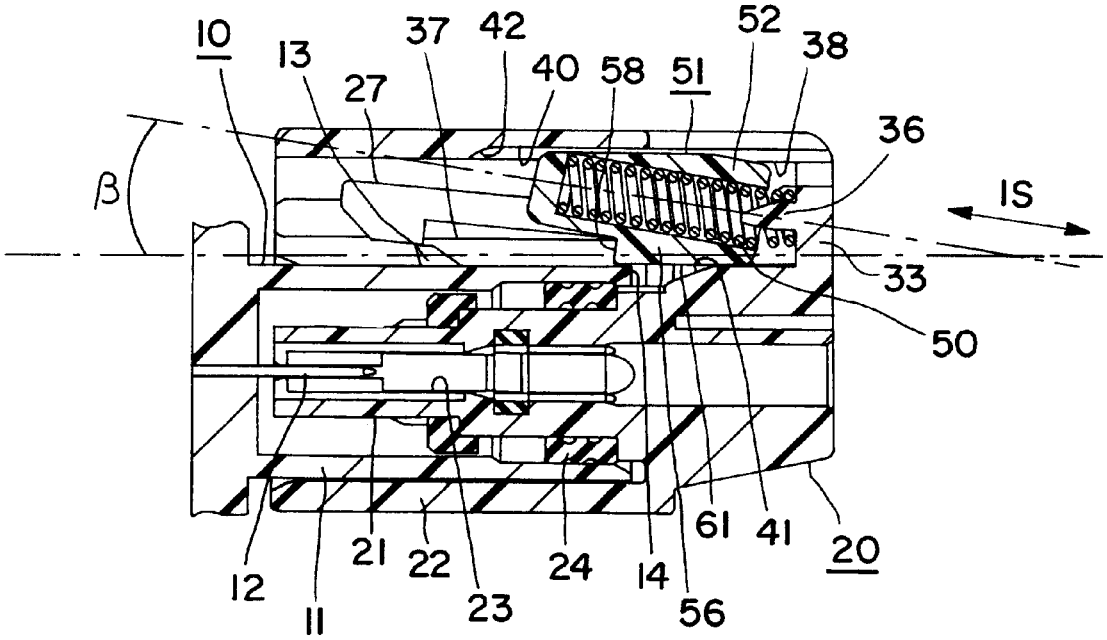

The guides 41 and the guidable portions 61 displace the pushable portion 58 to a height where the pushable portion 58 is no longer pushed by the pushing portion 14 when the housings 10, 20 are connected properly (see FIGS. 11(A), 11(B)).

Figure 12A:
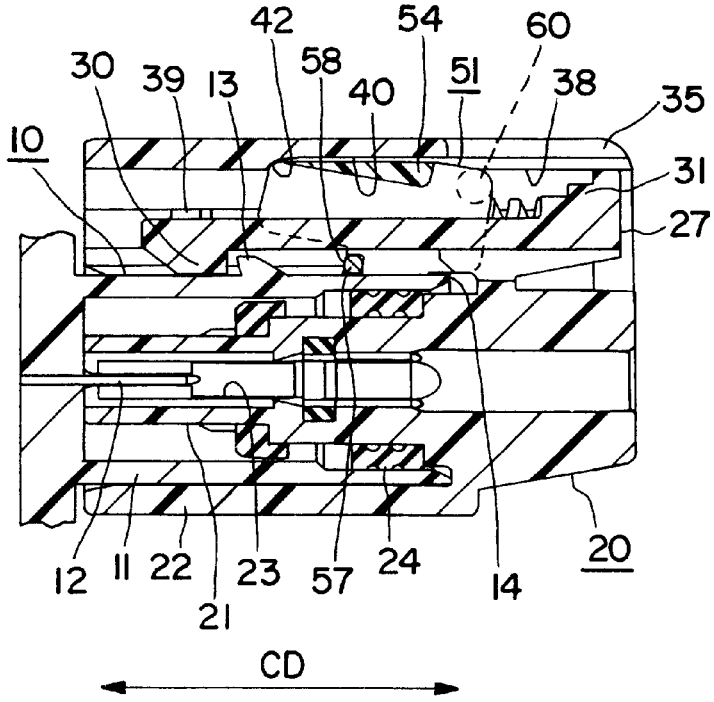
FIGS. 12(A) and 12(B) are sections similar to FIGS. 11(A) and 11(B) showing a state where the housings are properly connected with each other.
Figure 12B:
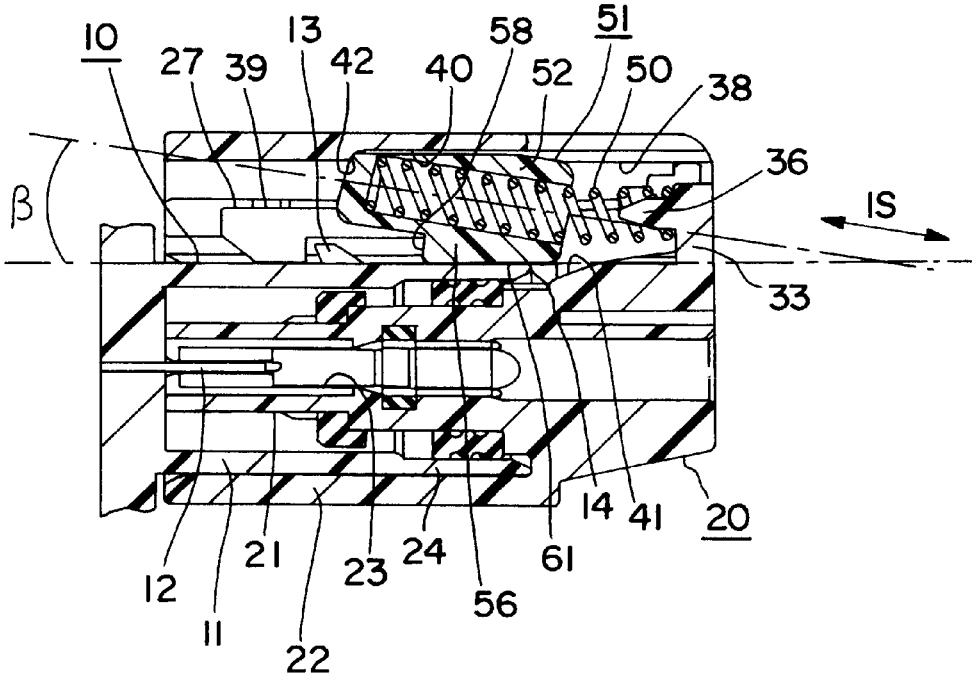

The biasing forces accumulated in the compression coil springs 50 are released with the slider 51 inclined. Thus, the slider 51 is moved forward until it contacts the stopper 42 at the front of the escaping groove 40, as shown in FIGS. 12(A) and 12(B). The front end of the slider 51 is held in contact with the stopper 42 and the guidable portions 61 are held in contact with the upper surface of the receptacle 11. Thus, the slider 51 is sloped upward toward its front end (FIG. 12). The compression coil springs 50 are held in similar inclined postures, except for their portions fitted in the supporting projections 36. At this stage, the compression coil springs 50 are compressed and accumulate biasing forces. The length of each spring 50 is, for example, about 70 to 80% of its natural length. The stopper 42 defines a slanted surface that is sloped down to the front (FIG. 4). Thus, the stopper 42 guides the slider 51 obliquely down and forward to the initial position of the slider 51 when the slider 51 is no longer supported by the receptacle 11. The front end 51*a* of the slider 51 that contacts the stopper 61 has an arcuate surface (FIG. 7).

The connector is assembled by mounting the coil springs 50 and the slider 51 into the upper part of the outer tube 22 of the female housing 20 from the front. The springs 50 initially are held parallel with connecting direction, as shown in FIGS. 4(A) and 4(B). Thereafter, the receptacle 11 of the male housing 10 is fit between the terminal accommodating portion 21 of the female housing 22 and the lower part of the outer tube 22.

Figure 9A:
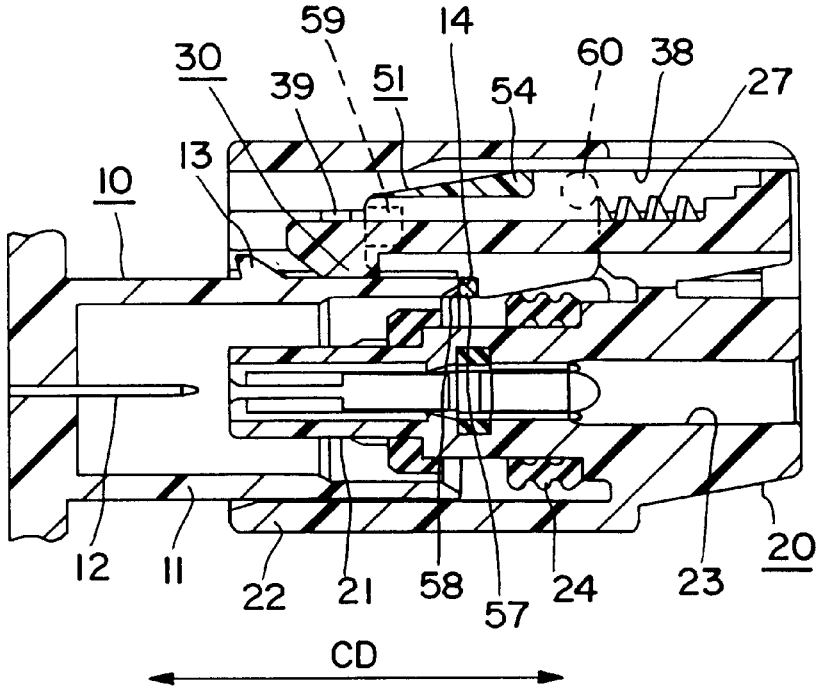
FIGS. 9(A) and 9(B) are sections similar to FIGS. 4(A) and 4(B) showing an initial stage of connection of the two housings.
Figure 9B:
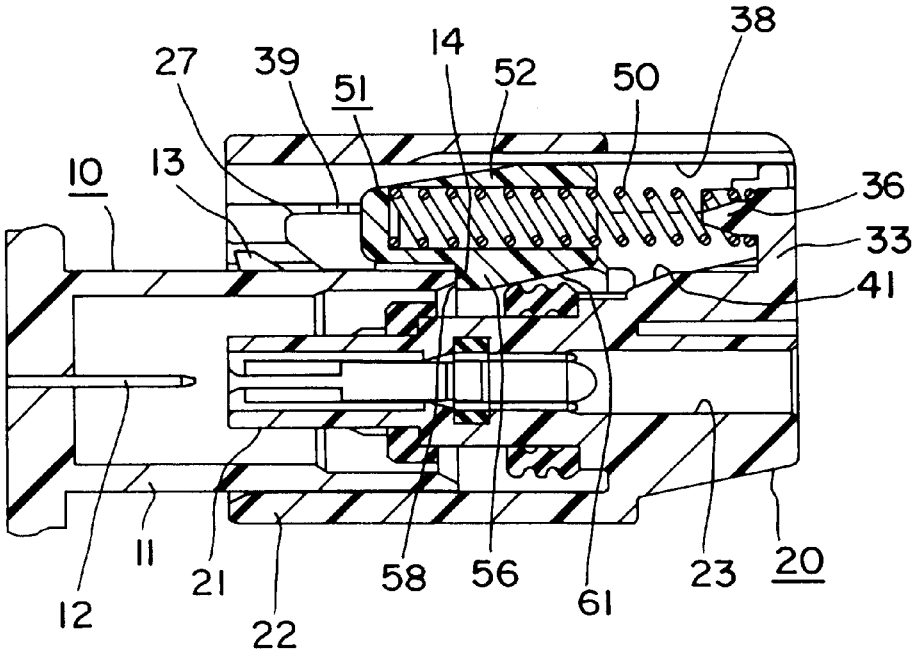

The pushing portion 14 engages the pushable portion 58 when the housings 10, 20 are fit to specified depth, as shown in FIGS. 9(A) and 9(B). As connection proceeds, the pushing portion 14 pushes the pushable portion 58, and moves the slider 51 back and away from the male connector housing 10 while resiliently compressing the compression coil springs 50 (see FIG. 10). The slider 51 is moved back during this movement and is aligned substantially along the connecting direction CD by the sliding contact of the front-stop projections 59 with the bottom surfaces of lower guide grooves 37 and the sliding contact of the supporting pins 60 with the upper and bottom surfaces of the upper guide grooves 38. The male tab terminals 12 preferably have not yet entered the cavities 23 of the terminal accommodating portion 21 at this stage.

The connecting operation may be interrupted halfway. However, the pushable portion 58 of the slider 51 is biased forward by the release of the biasing forces accumulated in the resiliently compressed coil springs 50 and pushes the pushing portion 14 to separate the housings 10, 20. This prevents the housings 10, 20 from being left partly connected.

Figure 10A:
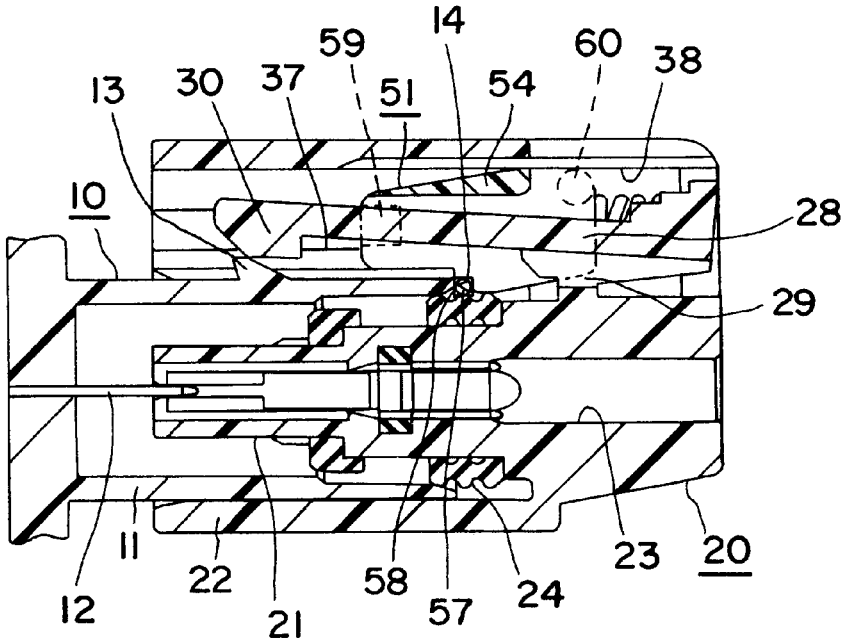
FIGS. 10(A) and 10(B) are sections similar to FIGS. 9(A) and 9(B) showing an intermediate stage of connection of the two housings.
Figure 10B:
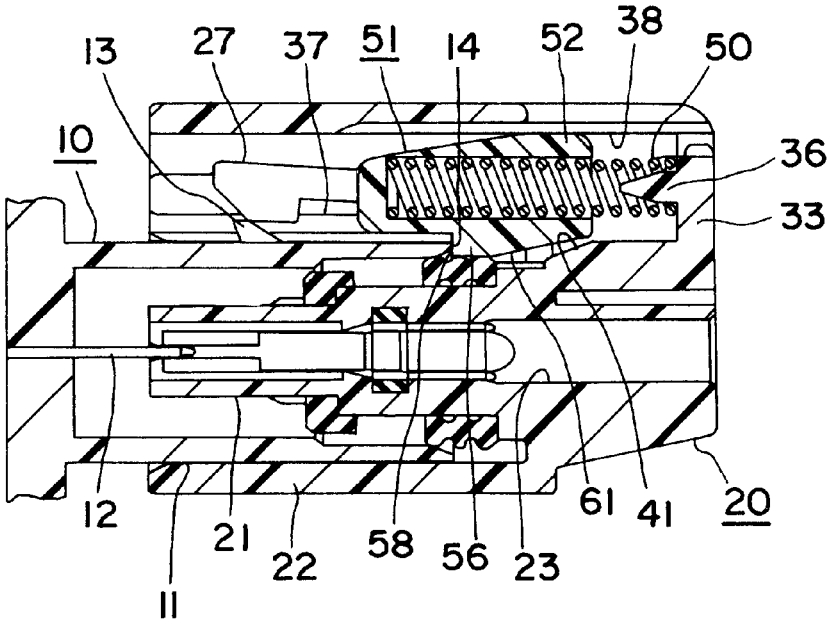

Continued movement of the housings 10, 20 in the connecting direction CD causes the lock arm 27 to deform resiliently and to move onto the locking projection 13, as shown in FIGS. 10(A) and 10(B). Additionally, the slider 51 is moved back sufficiently for the guidable portions 61 of the slider 51 to engage and move onto the guides 41. As a result, the slider 51 inclines about the axes A of the supporting pins 60 so that the front of the slider 51 moves up, while the rear of the slider 51 is vertically immovable. The top of the slider 51 enters the escaping groove 40, and the front-stop projections 59 disengage from the bottom surfaces of the lower guide grooves 37. As the slider 51 is inclined, the pushable portion 58 moves up, thereby gradually reducing the area of the pushable portion 58 that is in contact with the pushing portion 14.

The slanted top surface 52*b* of the slider 51 pivots into contact with the upper surface of the escaping groove 40 and the pushable portion 58 pivots out of engagement with the pushing portion 14 substantially when the housings 10, 20 are fitted to a proper depth, as shown in FIGS. 11(A) and 11(B). The mating terminal fittings are connected electrically and the lock arm 27 is restored resiliently substantially to its original shape when the housings 10, 20 are connected properly. Thus, the housings 10, 20 are held inseparably in their properly connected state by the engagement of the rear surface of the locking claw 30 with the rear surface of the locking projection 13.

The pushable portion 58 is released from the pushing portion 14 when the housings 10, 20 are connected completely. As a result, the biasing forces of the compression coil springs 50 move the slider 51 forward in its inclined posture until the front end of the slider 51 contacts the stopper 42. The slider 51 is aligned along a direction IS at an angle β to the connection direction CD, as shown in FIG. 12, and is held in this upwardly inclined posture by the engagement of the slider 51 with the stopper 42 and by the support of the guidable portions 61 on the upper surface of the receptacle 11. The compression coil springs 50 also are held in inclined postures similar to the slider 51, except for portions of the springs 50 in the supporting projections 36. The springs 50 are compressed to about 70 to 80% of their natural length, and accordingly the slider 51 still is biased forward.

Figure 13A:
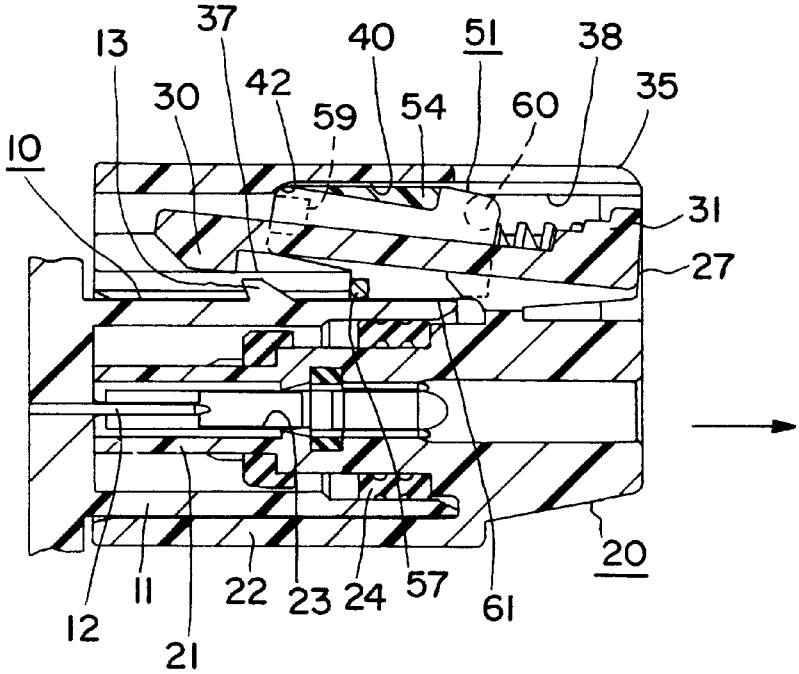
FIGS. 13(A) and 13(B) are sections similar to FIGS. 12(A) and 12(B) showing an operation of separating the two housings.
Figure 13B:
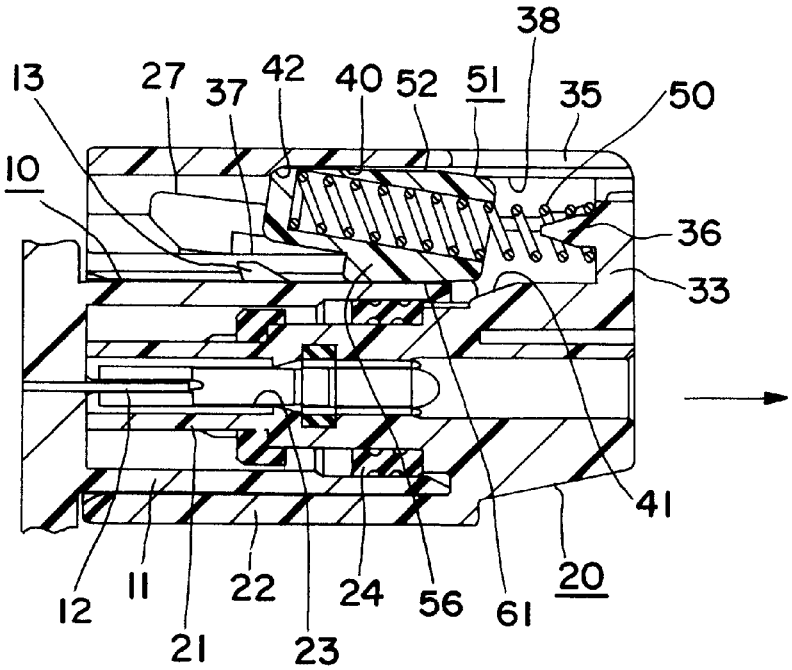

The housings 10, 20 might have to be detached from each other for maintenance. This is accomplished by pushing down through the notch 35 onto the operable portion 31 with sufficient force to deflect the front end of the lock arm 27 up and away from the lock 13, as shown in FIGS. 13(A) and 13(B). The housings 10, 20 then can be pulled apart. During this process, the receptacle 11 moves out of supporting engagement with the guidable portions 61 of the slider 51. As a result, the biasing forces of the resiliently compressed coil springs 50 are released and the springs 50 elongate to move the slider 51 to the front. The downwardly sloped slanted surface of the stopper 42 guides the slider 51 obliquely down as the springs 50 propel the slider 51 forwardly. As a result, the slider 51 is returned automatically to the initial position where it extends along connecting direction CD, as shown in FIGS. 9(A) and 9(B).

As described above, the pushable portion 58 is displaced angularly away from the pushing portion 14 by the guiding portions 41 to release the compression coil springs 50. Thus, the connector is small along the connecting direction, as compared to prior art connectors in which the slider and the compression coil springs are moved back along connecting direction CD.

The slider 51 and the compression coil springs 50 are held in upwardly sloped inclined postures when the housings 10, 20 are connected properly. Thus, the connector can be smaller in a direction intersecting the connecting direction CD, as compared to a case where the slider and the compression coil springs extend along connecting direction CD. Further, in the above case, the compression coil springs are bent like a crank. However, the compression coil springs 50 in this embodiment can be held in the inclined postures, and stress on the coil springs 50 is low.

The springs 50 are compressed resiliently when the housings 10, 20 are connected properly and the stopper 42 for supporting the slider 51 has a downwardly sloped slanted surface. Additionally, the inclined slider 51 loses the support of the receptacle 11 as the receptacle 11 is withdrawn during the separation of the housings 10, 20. As a result, the biasing forces accumulated in the compression coil springs 50 are released and the slider 51 is guided back to its initial position by the slanted stopper 42. In this way, the slider 51 can be returned automatically to its initial position as the housings 10, 20 are separated from each other, and operability during the separation is good.

The opening edge of the receptacle 11 of the male housing 10 functions as the pushing portion 14. Therefore, the construction of the male housing 10 can be simplified because a special pushing portion is not needed.

The present invention is not limited to the above described and illustrated embodiment. For example, following embodiments also are embraced by the technical scope of the invention as defined in the claims. Beside the following embodiments, various changes can be made without departing from the scope and spirit of the invention as defined in the claims.

The opening edge of the receptacle 11 is the pushing portion 14 in the foregoing embodiment. However, the pushing portion may be a rib that projects from the receptacle 11 for pushing the front end surface of the slider 51. This eliminates the need to provide the slider with the pushable portion.

The guides 37, 38, 41 guide the slider 51 out in the height direction in the foregoing embodiment. However, guides may cause the slider 51 to escape laterally if the pushing portion is a rib that projects from the receptacle 11. This contributes to a further reduction of the height of the connector.

The slider 51 and the springs 50 are in inclined postures when the housings 10, 20 are connected properly in the foregoing embodiment. However, they may be moved by the guides into positions substantially parallel to connecting direction when the housings 10, 20 are connected.

The pushable portion 58 and the guidable portions 61 are provided in the slider 51, which is separate from the compression coil springs 50 in the foregoing embodiment. However, they may be formed integrally or unitarily with the springs 50 or other resilient member to omit the slider 51.

Although the compression coil springs are used as biasing members in the foregoing embodiment, leaf springs or resilient rods may be used.

Although the slider and the compression coil springs 50 are mounted in the female housing 20 in the foregoing embodiment, they may be mounted in the male housing 10.

What is claimed is:

1. A connector, comprising first and second connector housings that are connectable with each other, the first housing comprising:

a resilient member that accumulates a biasing force acting in a direction to separate the housings as the two housings are being connected to each other, the resilient member comprising a pushable portion to be pushed by a pushing portion provided on the second housing, a guide for guiding the pushable portion in a direction intersecting the connecting direction to displace the resilient member to a position free of the pushing portion, thereby moving the resilient member forward, as the housings are connected with each other, wherein the resilient member initially is arranged substantially along the connecting direction and has a rear end mounted on a supporting portion in the first housing and a front end, including the pushable portion, on a movable element, and wherein the movable element is held in an inclined posture sloped upward from the rear end toward the front end when the housings are connected properly with each other.

2. The connector of claim 1, wherein the pushing portion is a nonresilient portion of the second housing.

3. The connector of claim 1, wherein the movable element is in contact with a stopper in the first housing and is supported by an outer surface of the second housing while causing the resilient member to accumulate the biasing force when the housings are connected properly with each other.

4. The connector of claim 3, wherein the stopper is slanted sufficiently to guide the movable element to its initial position by the biasing force accumulated by the resilient member as the second housing is separated from the first housing.

5. The connector of claim 4, wherein the movable element is pivotable about an axis such that the movable element can be arranged in an orientation substantially parallel to the connecting direction and in a slanted orientation where its longitudinal axis is arranged at an angle with respect to the connecting direction.

6. The connector of claim 5, wherein in the slanted orientation the pushable portion is not pushed by the pushing portion when the housings are connected properly with each other.

7. The connector of claim 1, wherein the second housing comprises a tubular receptacle with an open front, and the pushable portion projects into an aligned with a front edge of the receptacle.

8. The connector of claim 7, wherein the pushing portion is the opening edge of the receptacle.

9. A connector, comprising first and second housings, the housings each having a front end, the front ends of the housings being connectable to one another by moving the housings along a connecting direction, the second housing having a receptacle with a substantially rigid leading end defining a pushing portion, the first housing comprising:

a terminal accommodating portion dimensioned for insertion into the receptacle along the connecting direction;

a slider movably disposed in the first housing for movement substantially parallel to the connecting direction, the slider having a pushable portion disposed for contact by the pushing portion during connection of the housings for moving the slider away from the front end of the first housing;

at least one spring disposed in the first housing for biasing the slider toward the front end of the first housing; and at least one guiding portion for inclining the slider sufficiently for separating the pushable portion from the pushing portion when the housings substantially reach a fully connected condition, such that the spring propels the inclined slider passed the pushing portion and toward the front end of the first housing, the guiding portion holding the slider in an inclined posture sloped upward from a rear end thereof toward a front end when the housings are connected properly with each other.

10. A method for assembling a connector comprising first and second housings that are connectable with each other, comprising the following steps:

fitting the housings with each other and thereby accumulating in a resilient member of the first housing a biasing force acting in a direction to separate the housings, pushing a pushable portion of the resilient member by a pushing portion of the second housing, and guiding the pushable portion in a direction intersecting connecting direction to displace it to a position spaced from the pushing portion, thereby moving the resilient member forward, as the housings are connected properly with each other, wherein a movable element of the resilient member is held in an inclined posture when the housings are connected properly with each other.

11. The method of claim 10, wherein a movable element of the resilient member is in contact with a stopper in the first housing and is supported by an outer surface of the second housing while causing the resilient member to accumulate the biasing force when the housings are connected properly with each other.

* * * * *